US006520327B1

(12) United States Patent
Boardman et al.

(10) Patent No.: US 6,520,327 B1
(45) Date of Patent: Feb. 18, 2003

(54) GOLF BAG FLEXIBLE COVER STRUCTURE HAVING DUAL DETACHABLE SIDE BAGS

(75) Inventors: David Allan Boardman, Richmond, VA (US); Leighton A. C. Klevana, Richmond, VA (US)

(73) Assignee: Bag Boy LLC, Richmond, VA (US)

( * ) Notice: Subject to any disclaimer, the term of this patent is extended or adjusted under 35 U.S.C. 154(b) by 38 days.

(21) Appl. No.: 09/922,899

(22) Filed: Aug. 6, 2001

(51) Int. Cl.[7] ..... A63B 55/00

(52) U.S. Cl. ..... 206/315.4; 150/159; 280/DIG. 6; 190/108

(58) Field of Search ..... 206/315.3, 315.4; 150/159; 280/DIG. 6; 190/108

(56) References Cited

U.S. PATENT DOCUMENTS

| | | | | | |
|---|---|---|---|---|---|
| 3,061,057 | A | | 10/1962 | Miller | |
| 3,316,951 | A | * | 5/1967 | Jacobson | 206/315.3 |
| 3,830,348 | A | | 8/1974 | Ohyama | |
| 4,081,061 | A | | 3/1978 | Tucker | |
| 4,436,189 | A | | 3/1984 | Baum | |
| 4,951,818 | A | | 8/1990 | Johnson | |
| 5,265,894 | A | * | 11/1993 | Dunn | 206/315.4 X |
| 5,509,515 | A | | 4/1996 | Guo | |
| 5,810,064 | A | * | 9/1998 | Sanderson et al. | 150/159 |
| 5,860,519 | A | | 1/1999 | Meyer | |
| 5,944,155 | A | | 8/1999 | Geary | |
| 6,109,402 | A | | 8/2000 | Godshaw | |
| 6,164,425 | A | | 12/2000 | Latshaw | |
| 6,213,267 | B1 | | 3/2001 | Miller | |
| 6,315,115 | B1 | * | 11/2001 | Bradshaw et al. | 206/315.4 |

* cited by examiner

*Primary Examiner*—Stephen P. Garbe
*Assistant Examiner*—Tri M. Mai

(57) ABSTRACT

A flexible cover structure for enclosing and protecting a golf club bag during its handling and transport, the cover structure including a flexible cover member and a rigid base member having dual spaced-apart rollers and pedestals, and including multiple elongated skid rails provided at the base member lower rear side. The cover structure is provided with dual detachable bags each centrally located along opposite sides of the cover member by a continuous zipper. The detachable bags are each provided with a main inner compartment containing a foldable handle and closable by have a zipper fastener extending around the bags upper peripheral edges, a secondary inner compartment provided in the bag forward portion, and a front pocket closable by a zipper. The dual side bags are each removable from the cover member, and after removal can be conveniently joined together along their rear sides by the same continuous zipper to provide a single bag assembly having four inner compartments and dual handles for convenient independent usage.

12 Claims, 4 Drawing Sheets

56
54
12b
42a
48
42b
49
44 45
47
51
50
41

GOLF BAG FLEXIBLE COVER STRUCTURE HAVING DUAL DETACHABLE SIDE BAGS

BACKGROUND OF INVENTION

This invention pertains to a golf bag travel cover structure having dual detachable external side bags. It pertains particularly to an improved golf bag flexible travel cover structure having two detachable external side bag units, which when removed from the travel cover outer surface are attachable to each other by suitable fastener means so as to form functional bag assembly for independent usage.

In response to a definite need by golfers to enclose and protect their valuable golf bags containing several expensive clubs during travel by public transportation, thereby requiring handling by baggage handling personnel and equipment, various protective cover designs for such golf bags have been developed and marketed. Also, it is usually desirable for a traveling golfer to carry along various other items of equipment or clothing, which can be conveniently contained in a bag removably attached to the golf bag cover structure. Although some such golf bag covers have been previously developed and are disclosed in the prior art, they all have various deficiencies in their construction and/or utility for a traveling golfer.

Pertinent prior art includes U.S. Pat. No. 3,061,057 to Miller discloses a hand luggage unit including a central main bag and dual auxiliary side bags attached by zipper onto the main bag, but the side bags are not independently usable. U.S. Pat. No. 3,830,348 to Ohyama discloses a collapsible luggage piece which can be folded and stored within a smaller piece provided in two combinable halves. U.S. Pat. No. 4,436,189 to Baum discloses a flexible garment bag having separable side bags attached thereto by zippers. U.S. Pat. No. 4,951,818 to Johnson discloses an elongated horizontal golf bag carrier having flexible side walls and multiple wheels, and has internal impact absorbing panels provided at each end. U.S. 5,265,894 to Dunn discloses an upright flexible wheeled cover adapted for enclosing a golf bag which has a zippered closure and a permanently attached side pouch sized for containing golfing equipment. U.S. Pat. No. 5,860,519 to Meyer et al discloses a substantially rigid golf bag which includes detachable storage pouches, a carrying strap and detachable wheels for ease of movement during travel. U.S. Pat. No. 5,944,155 to Geary discloses a structured main luggage bag having dual wheels and a small tote bag removably attached onto its outer front side. U.S. Pat. No. 6,164,425 to Latshaw discloses a rigid container unit for enclosing a golf bag, and includes dual wheels and at least one smaller piece of luggage removably attached to the main container by mating snap fasteners. U.S. Pat. No. 6,213,267 to Miller discloses a portable luggage case having dual detachable bag pieces which can be combined together to form a single unit for independent use. However, further improvements in travel covers for golf bags are desired by golfers to provide increased convenience and flexibility in their use during and after travel by public transportation such as by airplane.

SUMMARY OF INVENTION

It is an object of this invention to provide an improved flexible cover structure for golf bags which provides added convenience and safety for retaining a golf bag during handling and travel by public transportation.

Another object of the invention is to provide a cover structure for golf bags which alone is relatively flexible and light weight, but when enclosing a golf bag has sufficient rigidity to permit convenient and safe handling during travel.

A further object is to provide such a cover structure including dual detachable side bags which are removably attached to the cover central portion, and when removed therefrom can be attached together to form a single bag assembly suitable for independent usage.

This invention provides an improved generally flexible cover structure adapted for enclosing and protecting a golf bag containing several clubs, such as during baggage handling and travel by public transportation on airplanes and trains. The cover structure is adapted for reliably enclosing a golf bag for convenient and safe handling by personnel during its transport, and also includes dual detachable side bags or pouches which are each removably attached suitable fastening means to the cover structure outer surface along its two opposite side central portions.

The golf bag cover structure has an elongated shape and is made of a durable flexible woven fabric material stitched together with a beading provided along its seams. The cover structure includes a rigid base member located at the cover lower end and which has a rear portion extending upwardly along its rear side. The base member is equipped with dual spaced-apart rollers and dual pedestals each attached to the lower surface of the rigid base member, and also includes multiple elongated bumper rails attached to the rear extended portion of the base member to facilitate its handling over uneven surfaces and particularly on stairs. The cover structure upper portion includes multiple internal padding elements attached to the cover member inner walls, and adapted for cushioning and protecting the golf club heads against impact. The cover structure also includes a towing handle provided at the cover upper end, dual carrying handles provided along the cover front side at an intermediate location, and also has a handle provided at its front lower end.

It is an important feature of this invention to provide a cover structure for golf bags which is inherently relatively flexible and light weight, but whenever a golf bag is enclosed inside the cover structure becomes sufficiently rigid to provide for convenient handling by personnel during transport. The cover structure of this invention includes dual detachable bag units which are each removably attached by suitable fasteners such as a zipper to the cover outer surface portions at a central or intermediate location along its two opposite sides. Each of the two side bag units attached to the golf bag travel cover structure provide additional storage space for golf equipment and personal items such as shoes, shirts, and such. Each of the dual side bag units is preferably provided with a portion of a two part zipper track and when removed and joined together forms the unitary and independent travel bag.

The dual detachable bag units are each provided with a main inner compartment closable by a zipper fastener extending along three peripheral edges of the bags, a secondary inner compartment located in the forward portion of the bag and also includes a front pocket which is closable across the pocket upper end by a zipper. A flexible folded handle is provided attached within at the upper portion of each bag unit. After the dual side bags have each been detached from the two opposite sides of the golf bag cover structure, the folded handle can be withdrawn from the interior of each bag and the bags can then be conveniently joined together by the same zipper means to provide a combined bag assembly having dual inner compartments and dual handles for separate independent usage such as a personal bag or briefcase.

DESCRIPTION OF INVENTION

Figure 1:
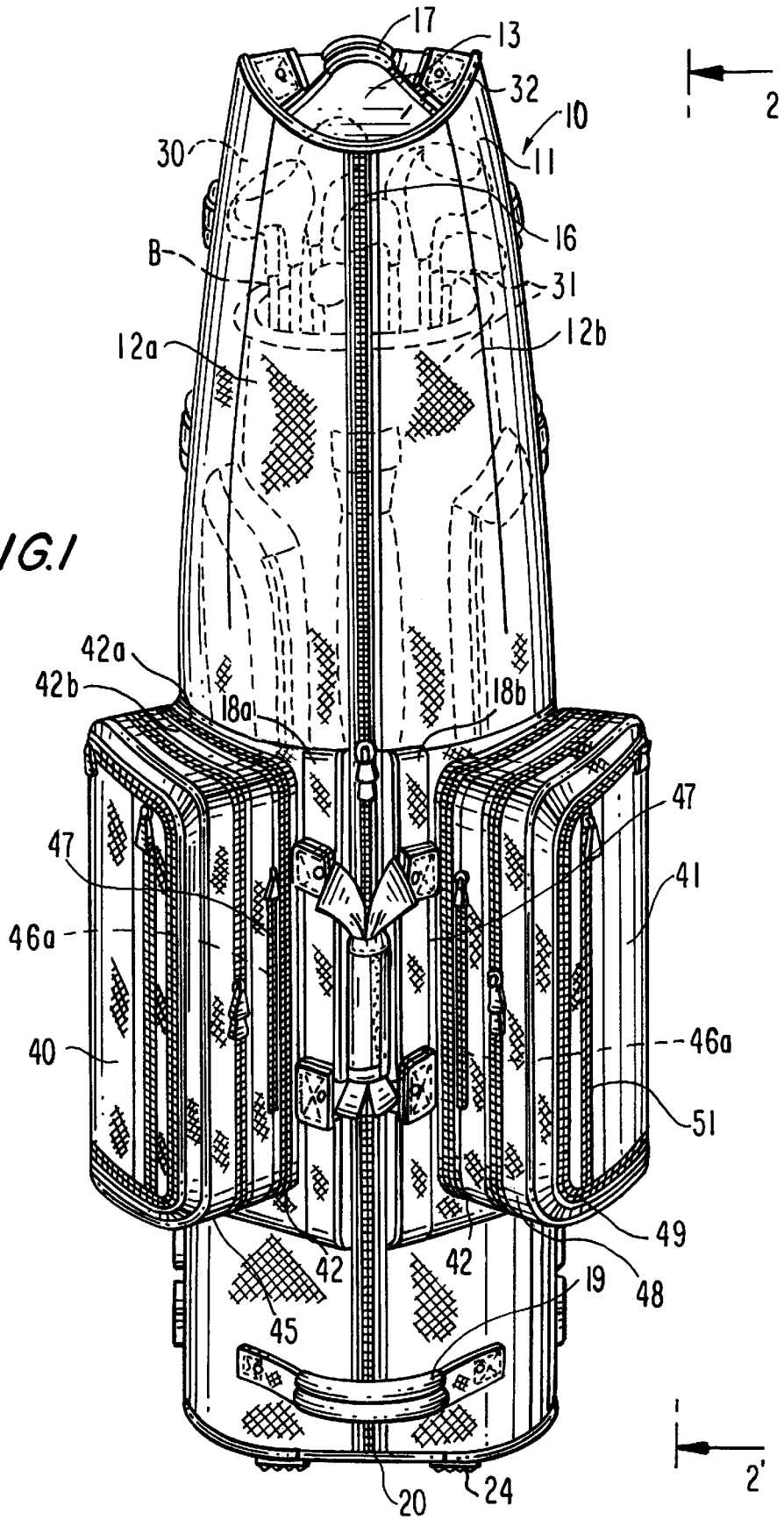
FIG. 1 is a perspective elevational view of the golf bag cover structure having dual detachable bag units provided along opposite sides of the cover structure according to this invention.

As shown by FIGS. 1–4, the golf bag cover structure 10 according to this invention has an elongated configuration having a generally triangular cross-sectional shape at its upper end, and a generally rectangular cross-sectional shape at its lower end. The cover structure 10 includes a flexible waterproof fabric cover member 11 which can be made of canvas, nylon or polyester. The structure 10 has two opposite sides 12*a* and 12*b*, an upper end 13, and a rear side 14 which provide an inner enclosure 15 which is closable by a elongated zipper 16 extending along between the two opposite sides 12*a* and 12*b*. The cover structure 10 has an upper towing handle 17 provided attached securely onto the cover member upper end, has dual flexible side carrying handles 18*a* and 18*b* attached onto the cover member sides 12*a* and 12*b* respectively at a central or intermediate position, and has a lower handle 19 provided at the cover structure lower end, all for providing convenient handling of the cover structure 10 during travel by a golfer.

Figure 2:
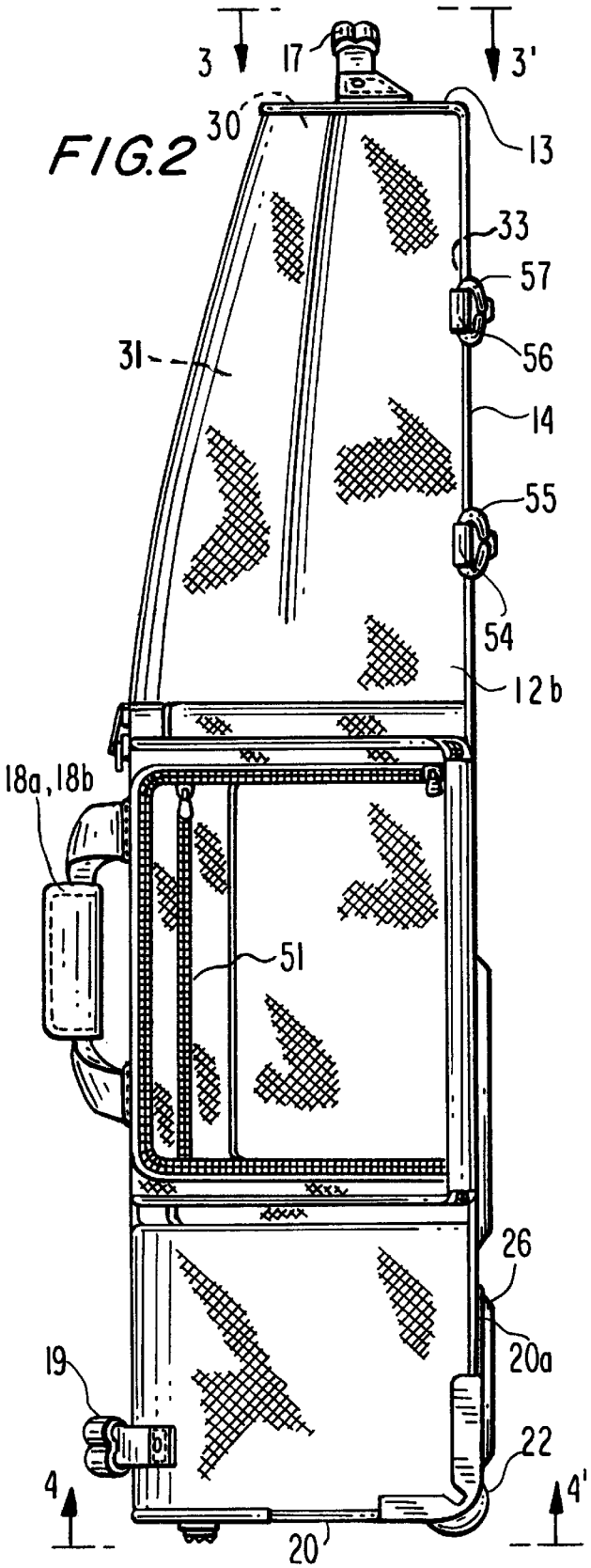
FIG. 2 is an elevational side view of the cover structure taken along lines 2–2' of FIG. 1 and showing one of the dual detachable side bags.
Figure 3:
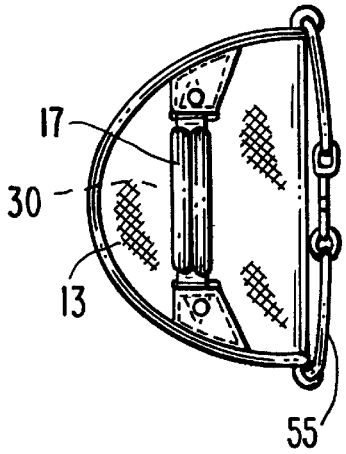
FIG. 3 is an end view of the cover structure upper end taken along lines 3–3' of FIG. 2.
Figure 4:
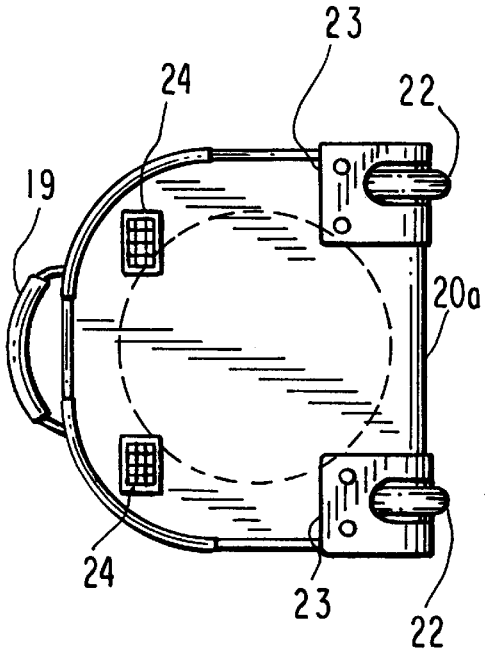
FIG. 4 is an end view of the cover structure lower end taken along lines 4–4' of FIG. 2.
Figure 5:
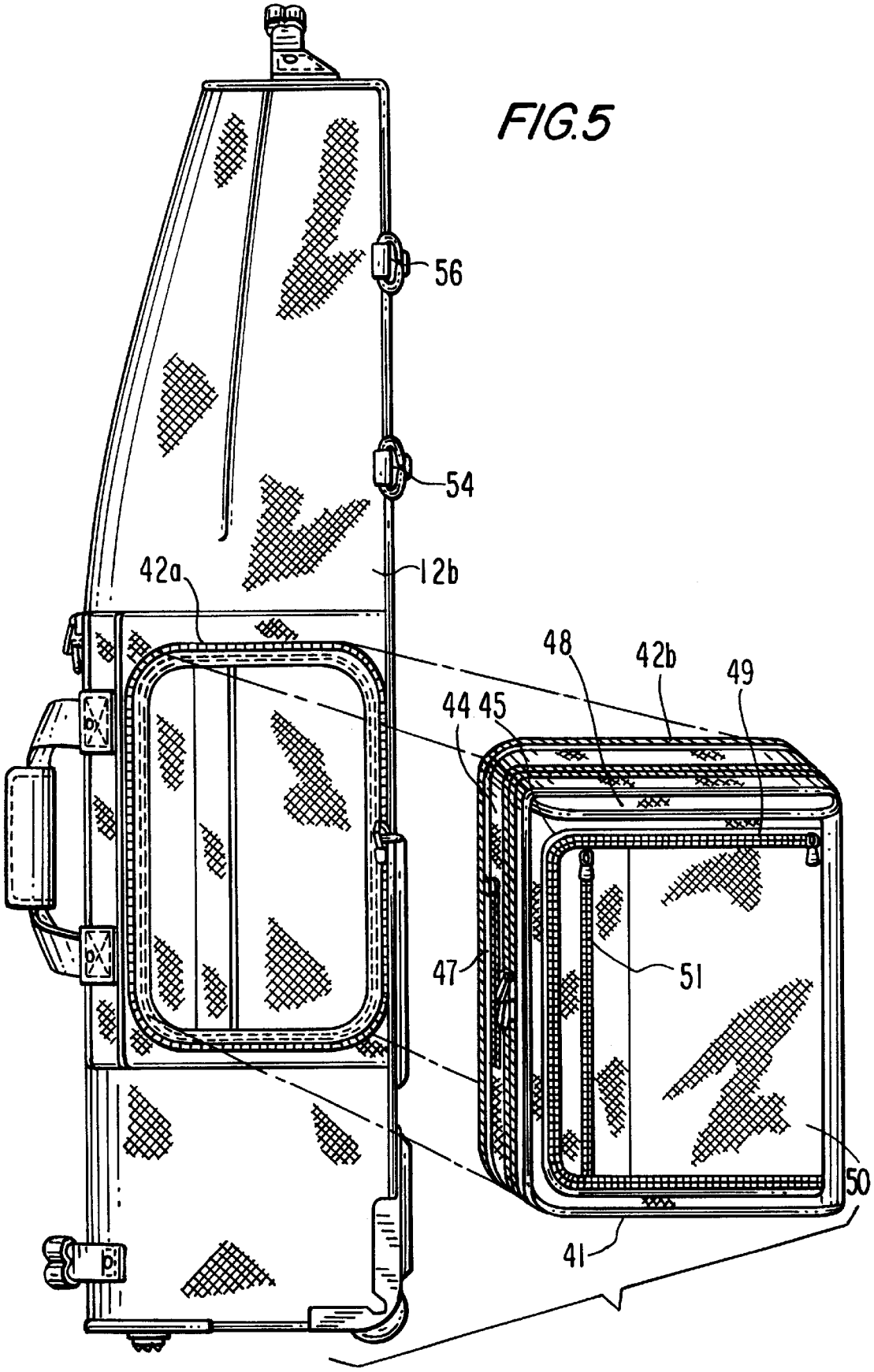
FIG. 5 is a perspective view similar to FIG. 2 and showing one of the dual side bags after its detachment from the cover structure.

The cover structure 10 has provided at its lower end a rigid base member 20, which includes a rear extended portion 20*a* which extends upwardly along the cover lower rear portion for a distance equal to about a third of the cover structure total length. The base member 20 has a concave curved shape, and includes dual spaced-apart rollers 22 each provided within a recess 23 formed in the base member 20, and also includes dual spaced-apart pedestals 24 as best shown by FIGS. 2 and 4 for supporting the cover structure 10 when in an upright position. Multiple spaced-apart elongated rigid bumper elements 26 are attached longitudinally onto the rear extended portion 20*a* of base member 20 for protecting the cover member 11 against abrasion and wear during handling and especially during movement on stairs. There is provided within the inner upper portion of bag cover member 11 four padding elements 30, 31, 32 and 33, which are each stitched to the inner sides 12*a* and 12*b*, the upper side 13 and rear side 14 respectively, and serve to minimize any impact shocks to the golf club heads which may occur during handling of the cover structure 10. Also, dual spaced-apart inner strap means 34 are provided attached to the cover inner rear wall 14 for use in securely retaining a golf bag ("B" shown by dotted lines) within the enclosure 15 of cover structure 10.

Attached along each outer sides 12*a* and 12*b* of cover member 11 there is provided dual detachable bag units 40 and 41, which are each attached onto the cover member outer surface by a continuous zipper 42. The zipper 42 has one of its elements 42*a* stitched onto the outer surface of the side 12*a* or 12*b* of cover member 11, and the other zipper element 42*b* stitched onto the back side of each detachable bag unit 40 or 41. Each bag unit 40 and 41 has a main inner compartment 44 which is closable by a zipper fastener 45 extending along the upper peripheral edges of each bag unit 40 and 41, and includes a flexible foldable handle 46 which can be extended outwardly through a separate opening 46*a* in the bag upper edge and which is closable by a zipper 47. Also provided in the front portion of each bag unit 40 and 41 is a secondary compartment 48, which is closable along its sides and upper end by a zipper 49. Also, the front side of bags 40 and 41 each have a pocket 50 which is closable at its upper end by a transverse zipper 49.

Figure 6:
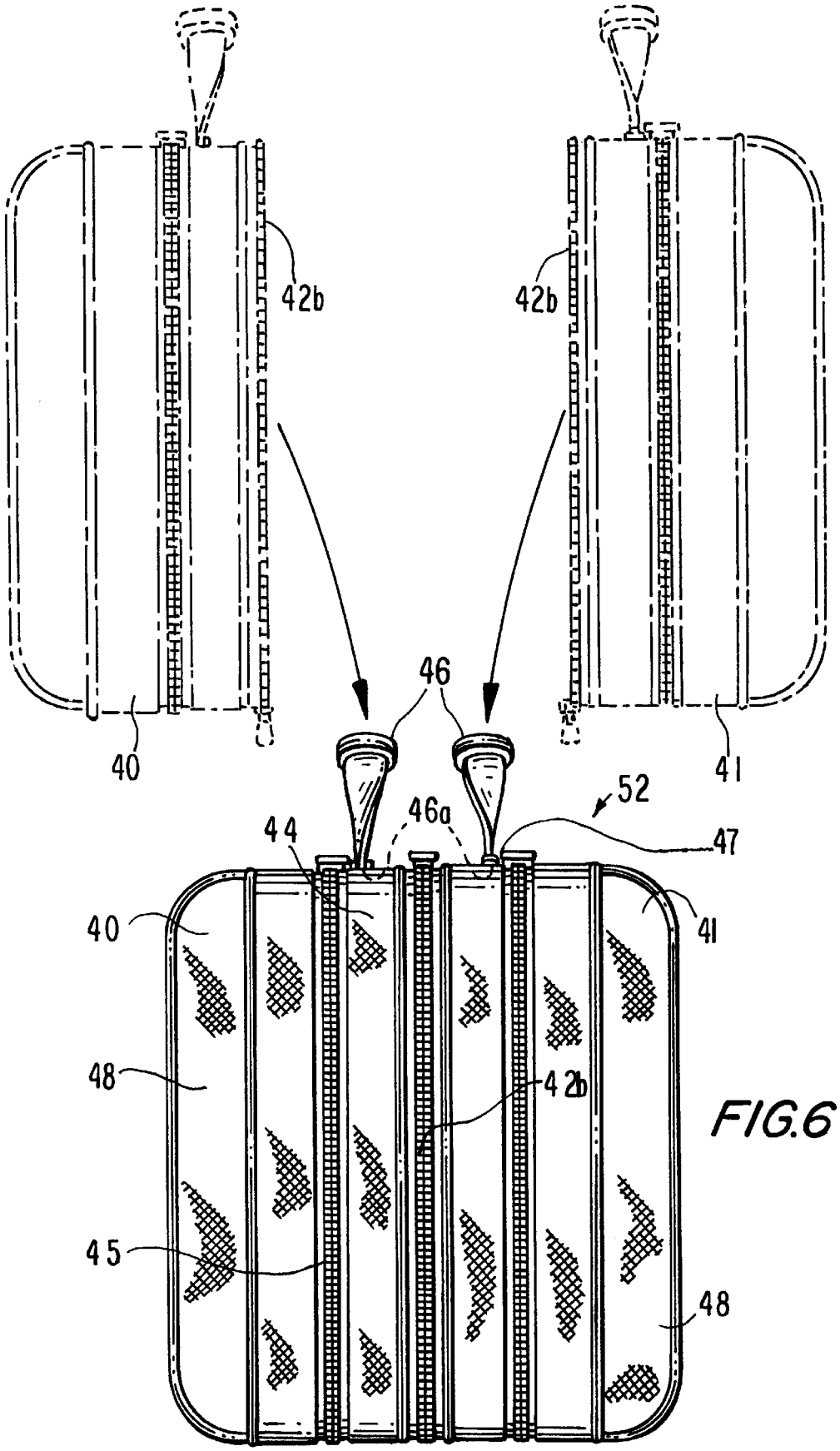
FIG. 6 is a perspective view of the two detachable side bags after being joined together along their rearward sides to form a single unitary bag assembly.

It is an important feature of this invention that after each of the dual detachable bag units 40 and 41 have been detached from sides 12*a* and 12*b* of the cover member 11 by the elongated zipper 42, they can then be conveniently joined together along their back sides by the zipper elements 42*b* to provide a unitary bag assembly 52 having dual handles 46, as shown by FIG. 6. This bag assembly 52 having two separate inner compartments and a front pocket is independently usable separate from the cover structure 10, which can be folded and stored until again needed at a later time for enclosing a golf bag during travel.

This golf bag cover structure will now be described further by use of the following example, which should not be construed as limiting the scope of this invention.

EXAMPLE

A golf bag elongated flexible travel cover structure is provided, which has a generally triangular cross-sectional shape at its upper end and a rectangular cross-sectional shape at its lower end. The cover is made of woven polyester fabric material and is stitched together with beading provided at its seams. The cover structure includes a lower rigid base member equipped with dual spaced-apart rollers and dual supporting pedestals, and also has multiple spaced-apart elongated bumper elements attached to a rear upwardly extended portion of the base member along its lower rear side. The cover structure is adapted for reliably enclosing and protecting a golf club bag, and includes dual detachable side bag units on each side of the cover, and which can be joined together to provide a independent unitary bag assembly.

Some important dimensions and features of the golf bag cover structure and dual detachable side bags are as follows:

| | |
|---|---|
| Cover structure overall length, in. | 50 |
| Cover structure width, in. | 14 |
| Base member width, in. | 14 |
| Base member rear extension length, in. | 20 |
| Cover member padding length, in. | 14 |
| Side bag length, in. | 18 |
| Side bag width, in. | 14 |

Although this invention has been described broadly and includes a preferred embodiment, it will be understood that modifications and variations can be made all within the scope as defined by the following claims.

We claim:

1. A flexible cover structure adapted for protectively enclosing a golf club bag, the cover structure comprising:

an elongated flexible cover member having two side portions and a rear portion arranged for providing an inner enclosure, said cover member having an elongated fastener means extending between upper and lower ends of the cover member two side portions for closing the enclosure;

a rigid base member provided attached to said cover member at the cover member lower end, said base member having a rear portion extending upwardly along said cover member rear side, said base member including dual spaced-apart rollers and dual spaced-apart pedestals attached onto the base member lower surface ind arranged for suppoting the cover structure when in an upright position:

multiple elongated rigid spaced-apart bumper elements fixedly attached longitudinally to said base member rear extended portion along its outer rear side;

an upper handle means attached onto an upper end portion of said cover member dual handle means attached along the front side portions of said cover member at an location intermediate the ends thereof, and a lower handle means attached onto said cover member near its lower end, all handles being adapted for moving or carrying the cover structure; and a detachable bag unit removably attached to said cover member at each of its two outer sides at a central location thereof by fastener means extending around the periphery of each bag unit, whereby each side bag member can be detached from said cover member for independent use.

2. The flexible cover structure of claim 1, wherein said cover member has a generally triangular cross-sectional shape at its upper portion and a generally rectangular cross-sectional shape at its lower portion.

3. The flexible cover structure of claim 1, including strap means attached to said cover member inner rear side within the enclosure, and adapted for securely retaining a golf bag within the enclosure.

4. The flexible cover structure of claim 1, wherein each said detachable bag member is attached to said cover member by continuous zipper means.

5. The flexible cover structure of claim 1, including multiple padding elements attached to said side and rear portions of said cover member within the upper portion of the cover member.

6. The flexible cover structure of claim 5, including a padding element attached within said cover member upper end.

7. The flexible cover structure of claim 1, wherein dual said detachable bag units each have a main inner compartment closable by a zipper extending around the upper edges of each bag unit, and each bag has a flexible handle folded down within the main inner compartment.

8. The flexible cover structure of claim 7, wherein each said bag has a secondary inner compartment located in its forward portion closable by a zipper.

9. The flexible cover structure of claim 7, wherein each detachable bag has a front pocket closable at its upper end by a zipper.

10. The flexible cover structure of claim 3, including a golf club bag and clubs retained within said enclosure.

11. The flexible cover structure of claim 4, wherein said detachable bags are each attached together along their rear sides by said continuous zipper to provide a single bag assembly having two inner compartments and dual handles attached to the bag assembly upper edge.

12. A flexible cover structure adapted for protectively enclosing a golf club bag, the cover structure comprising:

an elongated flexible cover member having a triangular cross-sectional shape at its upper end and a rectangular cross-sectional shape at its lower end, and including two side portions and a rear portion providing an inner enclosure, said cover member having an elongated zipper fastener means extending between upper and lower ends of the cover member two side portions for closing the enclosure;

a rigid base member provided attached to said cover member at the cover member lower end, said base member having a rear portion extending upwardly along said cover member rear side, said base member including dual spaced-apart rollers each located within a cavity provided in the base member and dual spaced-apart pedestals attached onto the base member lower surface and arranged for supporting the cover structure when in an upright position:

multiple elongated rigid spaced-apart bumper elements fixedly attached longitudinally to said base member rear extended portion along its outer rear side;

an upper handle means attached onto an upper end portion of said cover member, and dual handle means attached along the two side portions of said cover member at an location intermediate the ends thereof, and a lower end handle means attached onto said cover member near its lower end, all handles being adapted for moving or carrying the cover structure; and a detachable bag unit removably attached to said cover member at each of its two outer sides at a central location thereof by a continuous zipper means extending around the periphery of each bag unit, whereby each said side bag units can be removed from said cover member and attached together by said continuous zipper means to form a unitary bag assembly having dual inner compartments and dual flexible handles for independent use.

* * * * *